US010228184B2

(12) United States Patent
Crompton

(10) Patent No.: US 10,228,184 B2
(45) Date of Patent: Mar. 12, 2019

(54) WATER LINE GUIDE ASSEMBLY FOR INSERTING A FLUID LINE INTO A FLUID LINE VALVE OF AN APPLIANCE

(71) Applicant: Whirlpool Corporation, Benton Harbor, MI (US)

(72) Inventor: Edward E. Crompton, Iowa City, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 575 days.

(21) Appl. No.: 14/735,413

(22) Filed: Jun. 10, 2015

(65) Prior Publication Data

US 2016/0363246 A1 Dec. 15, 2016

(51) Int. Cl.
*F25B 45/00* (2006.01)
*F25D 23/12* (2006.01)

(52) U.S. Cl.
CPC .. *F25D 23/126* (2013.01); *B67D 2210/00047* (2013.01)

(58) Field of Classification Search
CPC ..... F25D 23/126
See application file for complete search history.

(56) References Cited

U.S. PATENT DOCUMENTS 2,274,409 A * 2/1942 Harbison ..... F25D 23/126 222/183
3,788,094 A * 1/1974 Benasutti ..... F25D 23/126 62/339
3,949,903 A * 4/1976 Benasutti ..... B01F 5/043 222/129.2
4,884,899 A * 12/1989 Schwartzman ..... F16C 17/10 384/100
5,857,596 A * 1/1999 Lee ..... B67D 3/0025 222/146.6
6,003,734 A * 12/1999 Oh ..... B67D 3/0003 141/351
6,257,278 B1 * 7/2001 Danielson ..... F16L 37/1215 137/614.03
6,964,352 B2 11/2005 Werth
7,159,406 B2 1/2007 Schuchart
7,810,345 B2 10/2010 Nebbia et al.
8,726,685 B2 5/2014 An
2004/0211790 A1 * 10/2004 Werth ..... F16K 7/063 222/212
2010/0275637 A1 11/2010 Park
(Continued)

*Primary Examiner* — Ljiljana Ciric
(74) *Attorney, Agent, or Firm* — Price Heneveld LLP

(57) ABSTRACT

A fluid line insertion guide for a refrigerator includes a collet adapted for engagement with a fluid line. The collet includes a biased end and an insertion end. The fluid line is inserted through a fluid line aperture defined within the biased end. The insertion end is configured to be inserted into a fluid valve to a final insertion depth to place the fluid line and fluid valve in communication with each other. A fluid line guide includes a retaining channel and a biasing surface. The retaining channel engages a valve housing to define a guide position. When the fluid line guide is in the guide position, the biasing surface is disposed a predetermined distance from a valve aperture of the fluid valve and further defines a position of the biased end of the collet and the final insertion depth of the insertion end into the fluid valve.

17 Claims, 11 Drawing Sheets

(56) References Cited

U.S. PATENT DOCUMENTS

| | | | | |
|---|---|---|---|---|
| 2012/0055190 | A1* | 3/2012 | Mitchell | F16L 37/56 62/389 |
| 2014/0007609 | A1 | 1/2014 | Lee | |
| 2014/0144619 | A1* | 5/2014 | O'Brien | E21B 23/02 166/237 |
| 2016/0332309 | A1* | 11/2016 | Harrach-Salazar | B25J 15/0491 |

* cited by examiner

WATER LINE GUIDE ASSEMBLY FOR INSERTING A FLUID LINE INTO A FLUID LINE VALVE OF AN APPLIANCE

BACKGROUND OF THE INVENTION

The device is generally in the field of water delivery and routing systems for appliances, more specifically, a fluid line guide for inserting a fluid line into a fluid valve at a predetermined, accurate insertion depth.

BRIEF SUMMARY OF THE INVENTION

In at least one aspect, a fluid line insertion guide for a refrigerator includes a collet adapted for engagement on an end of a fluid line. The collet includes a biased end, such as a biasing force receiving end, and an insertion end, wherein the fluid line is inserted through a fluid line aperture defined within the biased end. The insertion end is configured to be inserted into a fluid valve a final insertion depth to place the fluid line in communication with the fluid valve. A fluid line guide includes a retaining channel and a biasing surface, wherein the retaining channel engages a portion of a valve housing to define a guide position. When the fluid line guide is in the guide position, the biasing surface is disposed a predetermined distance from a valve aperture of the fluid valve and further defines a position of the biased end of the collet and the final insertion depth of the insertion end through the valve aperture and into the fluid valve.

In at least another aspect, a fluid line insertion guide for a refrigerator includes a fluid line guide including a first flange and a biasing surface, wherein a biasing region is disposed between the first flange and the biasing surface. A first collet is adapted for engagement on a first fluid line. The first collet includes a first biased end and a first insertion end, wherein the first fluid line is configured to be inserted through a first fluid line aperture defined within the first biased end, and wherein the first insertion end is configured to be inserted into a first fluid valve a final insertion depth to place the first fluid line in communication with the first fluid valve to define a guide position. The guide position is further defined by the first flange engaging a portion of a valve housing and the biased end positioned against the biasing surface and within the biasing region, wherein the biasing surface biases the first insertion end to the final insertion depth.

In at least another aspect, a method for inserting a fluid line into a fluid valve of a refrigerator includes providing a refrigerator having a fluid valve disposed proximate a valve housing, the fluid valve in communication with a fluid delivery system of the refrigerator. The method also includes providing a fluid line configured to deliver a fluid from the fluid valve to a fluid-related refrigerator function. A collet is provided as part of the method, wherein the collet includes a biased end and an insertion end, wherein the biased end includes a fluid line aperture adapted to receive the fluid line. The method also includes providing a fluid line guide including a retaining channel and a biasing surface, the retaining channel having at least one flange. According to the method, the collet is attached to the fluid line and the insertion end of the collet is placed into an aperture of the fluid valve, the insertion end being positioned at an initial insertion depth. The fluid line guide is placed on the collet and a portion of the valve housing, wherein the at least one flange slidably engages the valve housing to define a guide position wherein the biasing surface is disposed a first distance from a valve aperture of the fluid valve. The biasing surface is positioned proximate the biased end of the collet. Also, according to the method, the fluid line guide is moved toward a guide position, wherein the biasing surface engages the biased end and biases the insertion end of the collet toward the final insertion depth, and wherein the engagement of the at least one flange with the valve housing guides the movement of the fluid line guide to a lateral movement toward the guide position.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Figure 1:
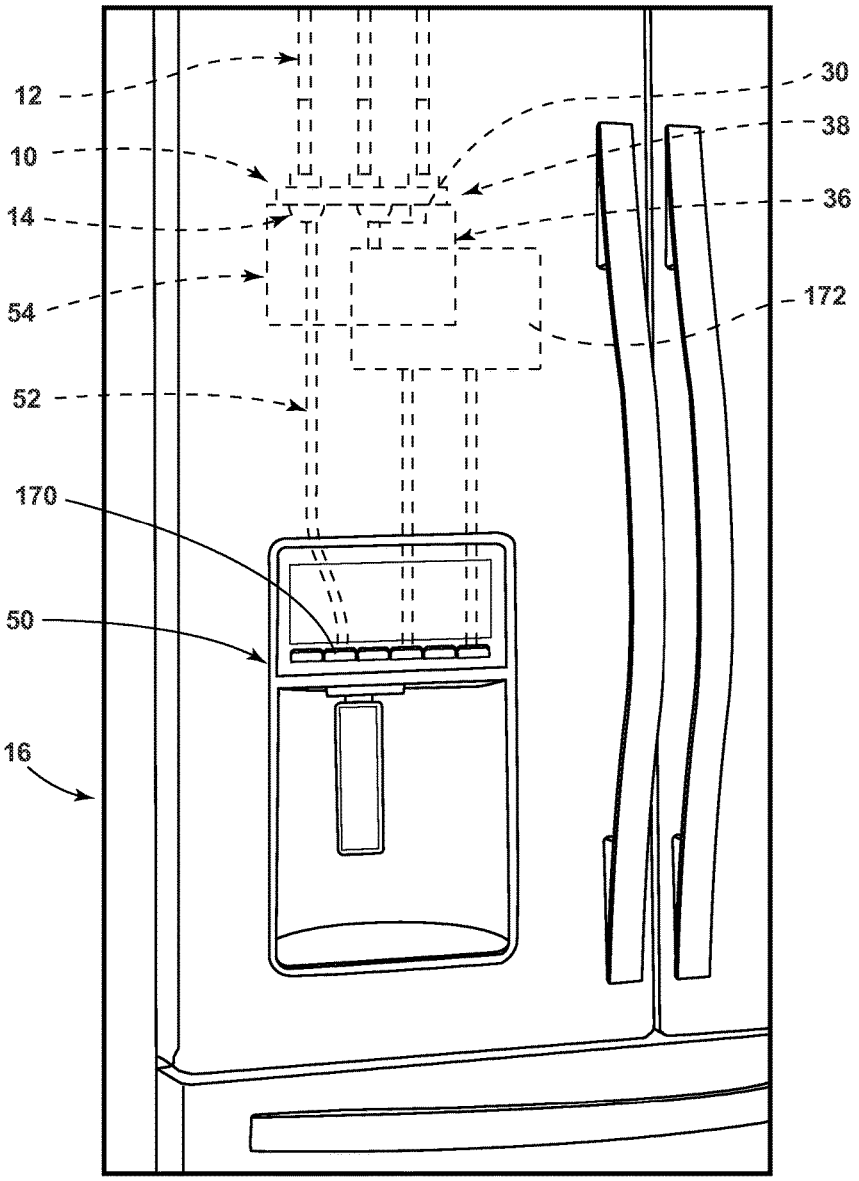
FIG. 1 is a front perspective view of a portion of an appliance incorporating an embodiment of the fluid line insertion guide.
Figure 2:
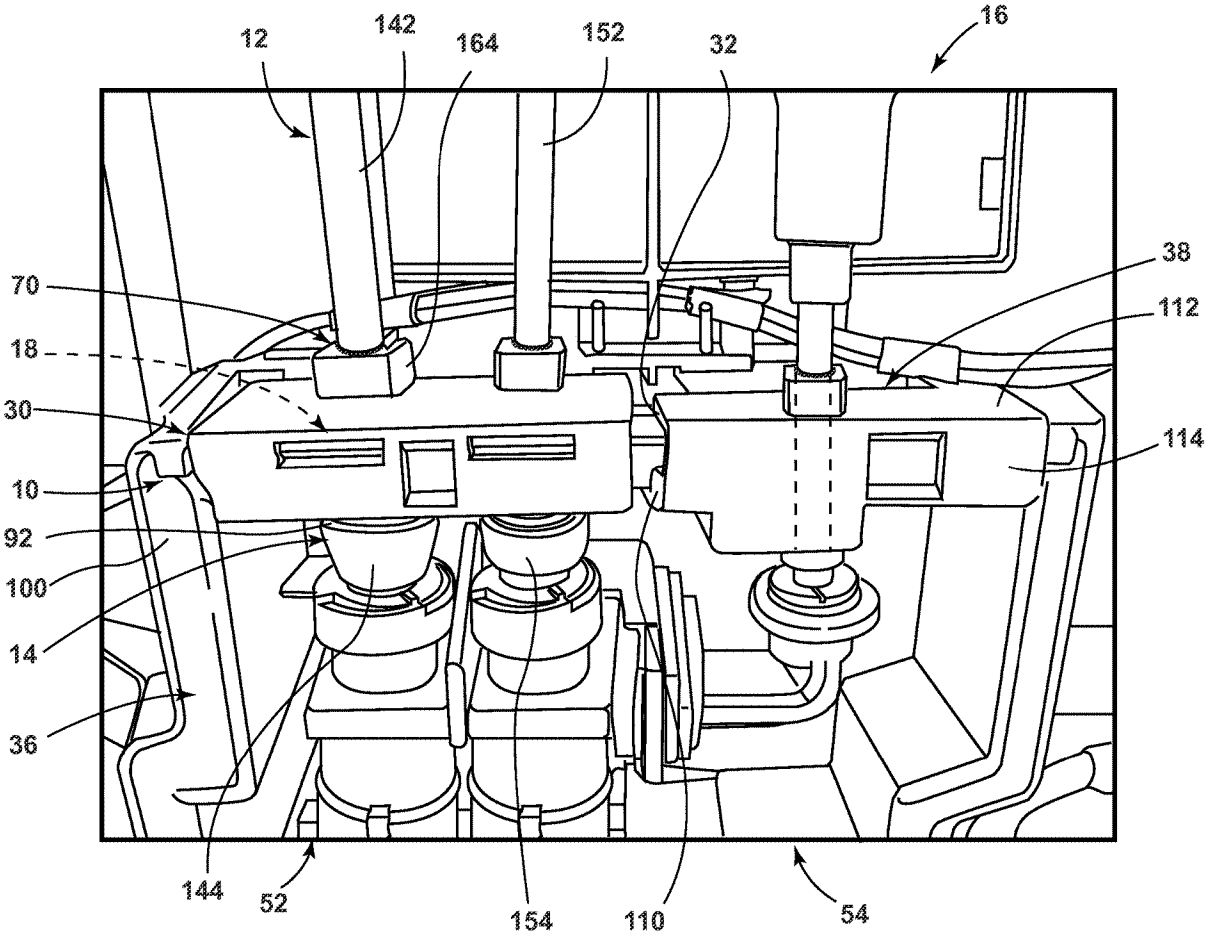
FIG. 2 is a top perspective view of a fluid valve assembly incorporating an aspect of the fluid line insertion guide showing the fluid line guide in the guide position and the various fluid lines installed at the final insertion depth.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

As illustrated in FIGS. 1-9, reference numeral 10 generally refers to a fluid line insertion guide used to insert a fluid line 12 into a fluid valve 14 for an appliance 16 at a predetermined final insertion depth 18 to insure proper installation of the fluid line 12 into the fluid valve 14, according to at least one embodiment. The fluid line insertion guide 10 includes a collet 20 that is adapted for engagement on the line end 22 of a fluid line 12. The collet 20 includes a biased end 24, such as a biasing force receiving end, and an insertion end 26. The fluid line 12 is inserted through a fluid line aperture 28 defined within the biased end 24 and the insertion end 26 of the collet 20 is configured to be inserted into the fluid valve 14 a predetermined final insertion depth 18 to place the fluid line 12 in communication with the fluid valve 14. A fluid line guide 30 includes a retaining channel 32 and a biasing surface 34. The retaining channel 32 engages a portion of a valve housing 36 to define a guide position 38. When the fluid line guide 30 is in the guide position 38, the biasing surface 34 is disposed a predetermined distance from a valve aperture 40 of the fluid valve 14. The guide position 38 further defines a position of the biased end 24 of the collet 20 and, in turn, an accurate (operably proper) predetermined final insertion depth 18 of the insertion end 26 through the valve aperture 40 and into the fluid valve 14. According to the various embodiments, the biasing surface 34 of the fluid line guide 30 includes an angled biasing surface 34. The angled biasing surface 34 of the fluid line guide 30 engages the biased end 24 of the collet 20. As the fluid line guide 30 is moved into the guide position 38, the angled biasing surface 34 biases the biased end 24, as well as the insertion end 26 of the collet 20 and the fluid line 12 into the final insertion depth 18 to substantially insure proper communication between the fluid line 12 and the fluid valve 14.

Referring again to FIGS. 1-3, the appliance 16, which can be a refrigerator, freezer, cooler, washer, steam-enabled dryer, steam-enabled oven, or other similar appliance incorporating fluid-related functions 50 can utilize the fluid line guide 30. The fluid is typically water, but conceivably could be another gas or liquid used by the appliance. It is contemplated that the appliance 16, exemplified in FIG. 1 as a refrigerating appliance, can include various fluid-related functions 50 that can include, but are not limited to, fluid dispensing, ice making, fluid filtration, and other similar fluid related functions 50. During manufacture of the appliance 16, various fluid lines 12 of a fluid delivery system 52 of the appliance 16 need to be installed to allow for delivery of a fluid, such as water, throughout the appliance 16 to operate the various fluid-related functions 50. During certain manufacturing steps, installation of these fluid lines 12 can be difficult as various components of the fluid valve assembly 54 can be at least partially obstructed and/or difficult to access in order to properly install the fluid line 12 into the various fluid valves 14 of the fluid valve assembly 54. The fluid line insertion guide 10 disclosed herein can assist the manufacturer in properly installing the various fluid lines 12 into the corresponding fluid valves 14 where visibility and accessibility of the components of the fluid valve assembly 54 may be limited or substantially or completely obstructed from ready view. Accordingly, the fluid line insertion guide 10 disclosed can assist the manufacturer in properly installing the various fluid lines 12 into the fluid valves 14 such that improper installation can be substantially avoided. Such improper installation can result in impeded fluid flow, fluid leaks, as well as potential damage to the appliance 16.

According to the various embodiments, as exemplified in FIGS. 1-9, the fluid line insertion guide 10 disclosed herein can allow the manufacturer of the appliance 16, and in particular the assembler of the fluid valve assembly 54, to install the various fluid lines 12 without necessarily seeing the fluid line 12 being inserted within the fluid valve 14 at the necessary predetermined final insertion depth 18. By using the fluid line insertion guide 10, the manufacturer of the appliance 16 can use the collet 20 to insert the insertion end 26 of the collet 20 into the fluid valve 14 at an initial insertion depth 60 (exemplified in FIG. 7), wherein the initial insertion depth 60 is defined by the installer of the fluid line 12 placing the insertion end 26 of the collet 20 partially into the fluid valve 14 by hand and without the use of tools. Once the insertion end 26 of the collet 20 is placed at the initial insertion depth 60, the installer of the fluid line 12 can use the fluid line guide 30 to bias the collet 20 and the fluid line 12 into the fluid valve 14 at the predetermined final insertion depth 18 for accurate operational depth/configuration. The process of achieving the predetermined final insertion depth 18 using the fluid line guide 30 will be described more fully below.

Referring again to FIGS. 2-9, the retaining channel 32 of the fluid line guide 30 can include a lateral support channel 70. It is contemplated that the lateral support channel 70 at least partially surrounds a portion of the fluid line 12 and substantially positions the fluid line 12 in a co-axially aligned position, or substantially co-axially aligned position, with respect to the valve aperture 40. In this manner, the lateral support channel 70 of the fluid line guide 30 provides lateral support to the fluid line 12 as it enters into the fluid valve 14. In this manner, the fluid line 12 can extend proximate the fluid valve 14 from various positions of the appliance 16 such that the fluid line 12 can bend around various components of the appliance 16 in order to reach the fluid valve 14. Due to the at least substantially laterally-supporting orientation, the lateral support channel 70 of the fluid line guide 30 allows the fluid line 12 to be fed into the fluid valve 14 without causing the fluid line 12 to fold, crimp, kink, buckle, pinch off, or otherwise limit the flow of fluid through the fluid line 12 or cause leaks in and around the fluid line 12 and/or the fluid valve 14.

It is contemplated that the lateral support channel 70 can surround the fluid line 12 on at least one side and potentially two, three or more sides to substantially surround or, completely surround, the fluid line 12 as it proceeds toward and into the fluid valve 14 of the fluid valve assembly 54. In providing lateral support to the fluid line 12, it is contemplated that the lateral support channel 70 of the fluid line guide 30 can be positioned substantially perpendicular to the retaining channel 32 of the fluid line guide 30. It is also contemplated that the lateral support channel 70 can be positioned in other non-perpendicular angles in relation to the retaining channel 32. These angles can be determined based upon several factors that can include, but are not limited to, the positioning of the fluid line 12 as it travels from one position of the appliance 16 and into the fluid valve 14, the positioning of various portions of the appliance 16 adjacent to and around the fluid valve assembly 54, and other similar considerations affecting the path of the fluid line 12 as it leads to and enters into the fluid valve 14.

Referring again to FIGS. 5-9, according to various embodiments, it is contemplated that the upper portion 80 of the lateral support channel 70 can define the biasing surface 34. The biasing surface 34 can include a predetermined slope 82, wherein the predetermined slope 82 biases the collet 20 into the valve aperture 40 as the fluid line guide 30 is moved into the guide position 38 to define the final insertion depth 18 of the insertion end 26. After the collet 20 has been inserted into the fluid valve 14 to the initial insertion depth 60, the fluid line guide 30 can be inserted around a portion of the collet 20 as well as the valve housing 36. In this manner, the biasing surface 34 of the fluid line guide 30 is configured to engage the biasing end of the collet 20. The lateral movement 84 of the fluid line guide 30 into the guide position 38 causes a perpendicular movement 86 of the collet 20. As the biasing surface 34 biases the biased end 24, the insertion end 26 of the collet 20 moves toward the final insertion depth 18. In this manner, the lateral movement 84 of the fluid line guide 30 is oriented in a substantially perpendicular direction to the positioning of the fluid line 12 as it enters into the fluid valve 14.

Referring again to FIGS. 2-9, in order to hold the fluid valve 14 in a substantially fixed position as the insertion end 26 of the collet 20 is moved into the final insertion depth 18, the valve housing 36 can include a valve flange 90 that engages the fluid valve 14. The fluid valve 14 can also include a positioning slot 92 that is defined within a portion of the fluid valve 14. It is contemplated that when the fluid valve 14 is installed within the fluid valve assembly 54, the positioning slot 92 of the fluid valve 14 is placed in a substantially secure engagement with the valve flange 90 of the valve housing 36. In this manner, the fluid valve 14 is held in place as the collet 20 is moved into the final insertion depth 18.

Referring again to FIGS. 3 and 7-9, the retaining channel 32 of the fluid line guide 30 is configured to be substantially the same thickness as a wall 100 of the valve housing 36 such that as the fluid line guide 30 is inserted onto the wall 100 of the valve housing 36, the movement of the fluid line guide 30 is limited to lateral movement 84 as the fluid line guide 30 is moved into the guide position 38. Because the wall 100 of the valve housing 36 limits the movement of the fluid line guide 30 to a lateral movement 84, the lateral movement 84 of the fluid line guide 30 causes the biasing surface 34 of the fluid line guide 30 to slidably engage the biased end 24 of the collet 20. The sliding engagement between the biasing surface 34 and the biased end 24 creates a ramping engagement between the biasing surface 34 and the biased end 24 of the collet 20 such that the biasing surface 34 moves the biased end 24 and a remainder of the collet 20 in the perpendicular movement 86 relative to the lateral movement 84 of the fluid line guide 30. It is contemplated that portions of the valve housing 36 can be configured to substantially encourage the linear movement of the collet 20 and the fluid line 12 into the fluid valve 14. Accordingly, portions of the valve housing 36 can substantially surround portions of the collet 20 in order to promote the linear displacement of the collet 20 and discourage rotational or lateral movement 84 of the collet 20 that might result in the collet 20 being disengaged from the fluid valve 14 as the fluid line guide 30 is moved into the guide position 38.

Referring again to FIGS. 7-9, as the fluid line guide 30 is moved to the guide position 38, the lateral movement 84 of the fluid line guide 30 positions the lateral support channel 70 that extends downward from the biasing surface 34 into engagement around the fluid line 12. In this manner, as the fluid line guide 30 is moved into the guide position 38, the fluid line guide 30 sets the collet 20 at the proper final insertion depth 18 and also substantially surrounds the fluid line 12 to provide lateral support for the fluid line 12.

Referring again to FIGS. 7-9, it is contemplated that the retaining channel 32 can be defined by a first flange 110 and the biasing surface 34, wherein the first flange 110 and biasing surface 34 are configured to engage at least a portion of the valve housing 36 to insure that movement of the fluid line guide 30 into the guide position 38 is limited to the lateral movement 84 along the portion of the valve housing 36. As discussed above, as the fluid line guide 30 is moved to the guide position 38, the biasing surface 34 of the fluid line guide 30 also engages the biased end 24 of the collet 20 and moves the collet 20 within a perpendicular direction relative to the lateral movement 84 of the fluid line guide 30.

It is further contemplated, as exemplified in FIGS. 5-9, that the lateral support channel 70 can extend through the second flange 112. The space defined by the lateral support channel 70 can also extend through the first flange 110 to define a guide aperture 120 within the first flange 110. In this manner, the lateral support channel 70 and the guide aperture 120 are configured to surround portions of the fluid line 12 and the collet 20. Accordingly, the lateral support channel 70 and the guide aperture 120 provide lateral support to the fluid line 12 and the collet 20, respectively, during installation of the fluid line guide 30 to the guide position 38.

Referring again to FIGS. 7-9, according to various alternate embodiments, the retaining channel 32 can be defined by first and second flanges 110, 112 that are spaced apart at a width that is similar to the thickness of a portion of the wall 100 of the valve housing 36 proximate the fluid valves 14. In this manner, the first and second flanges 110, 112 are configured to engage the valve housing 36 to substantially secure the fluid line guide 30 in the guide position 38 and also promote the lateral movement 84 of the fluid line guide 30 as it moves toward the guide position 38. In such an embodiment, the biasing surface 34 can extend from the second flange 112 such that the biasing surface 34 is disposed between the first and second flanges 110, 112. The biasing surface 34, in such an embodiment, extends upward from the second flange 112 and slopes toward the first flange 110.

Referring again to FIGS. 2-9, the fluid line guide 30 can include an abutment member 114 that extends from the first flange 110 to either the second flange 112 or the biasing surface 34, or both, depending on the configuration of the fluid line guide 30. The abutment member 114 can further define a biasing region 116 and/or the retaining channel 32. The abutment member 114 can also define an abutment surface 118 that is configured to engage a portion of the valve housing 36. In this manner, the engagement of the abutment surface 118 with the valve housing 36 communicates to the manufacturer when the fluid line guide 30 is in the guide position 38.

Figure 7:
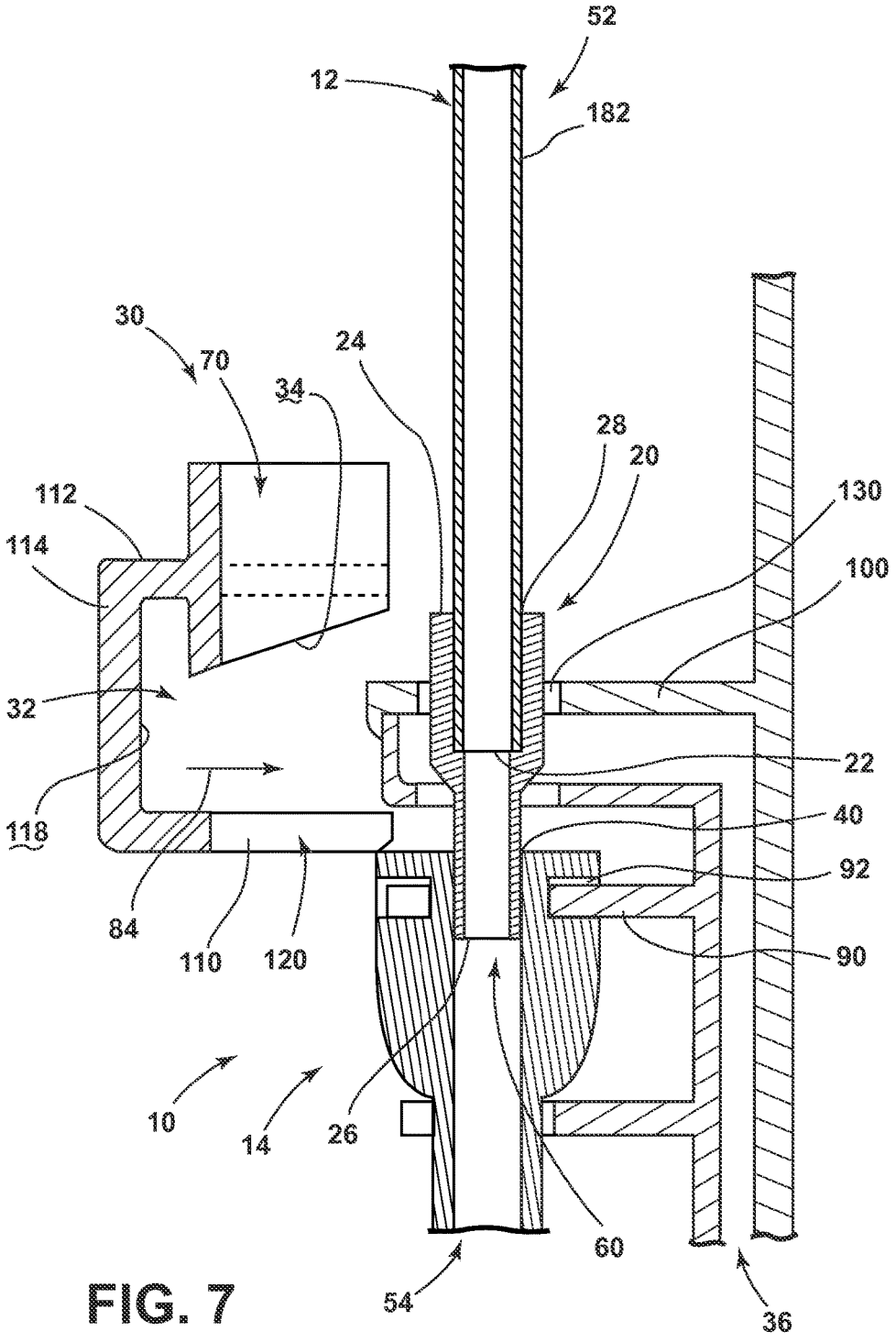
FIG. 7 is a cross-sectional view of the fluid valve assembly of FIG. 3 taken along line VII-VII and illustrating the fluid line at the initial insertion depth and the fluid line guide about to be placed on the valve housing.
Figure 8:
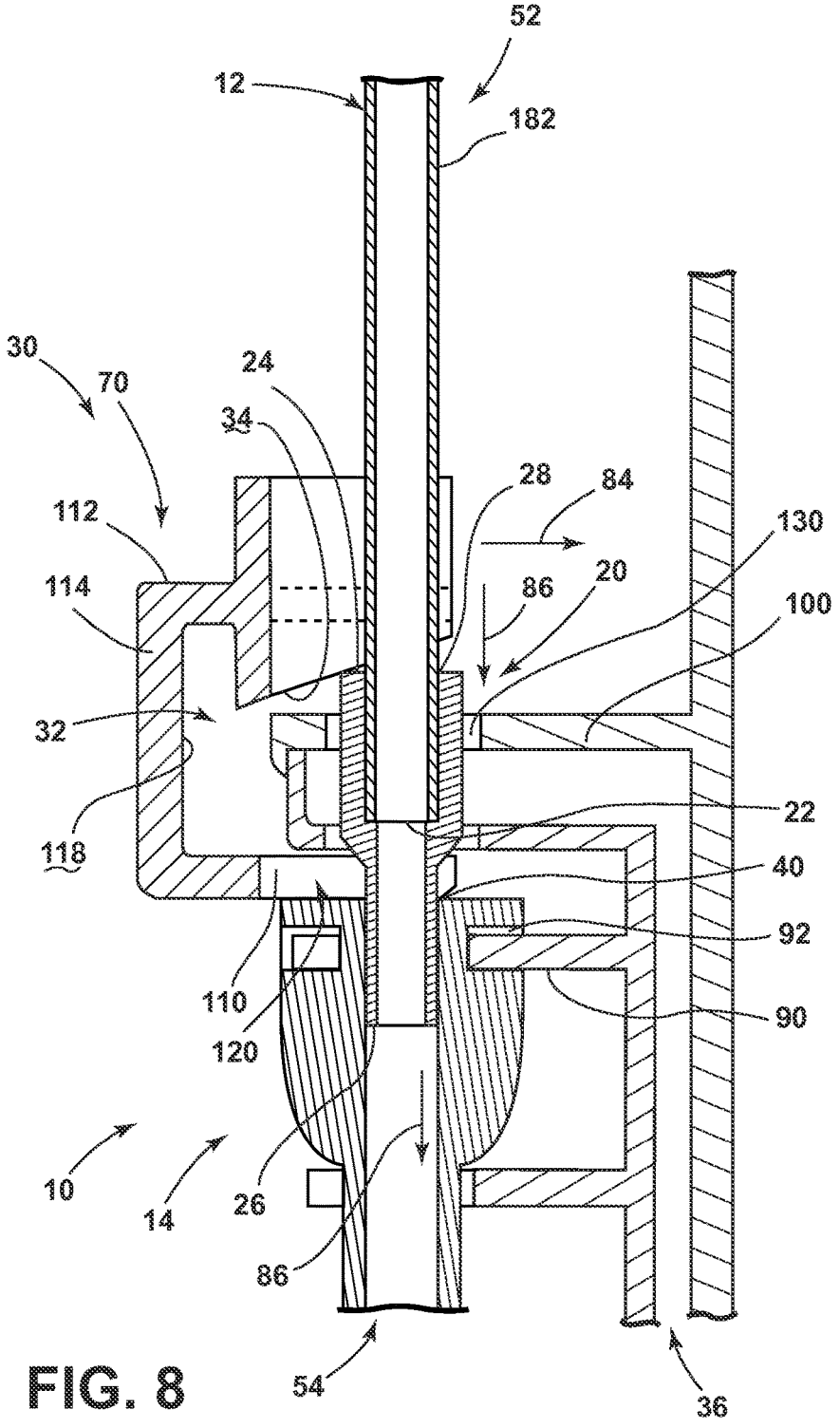
FIG. 8 is a cross-sectional view of the fluid valve assembly of FIG. 7 showing the fluid line guide being inserted onto the fluid valve assembly toward the guide position.
Figure 9:
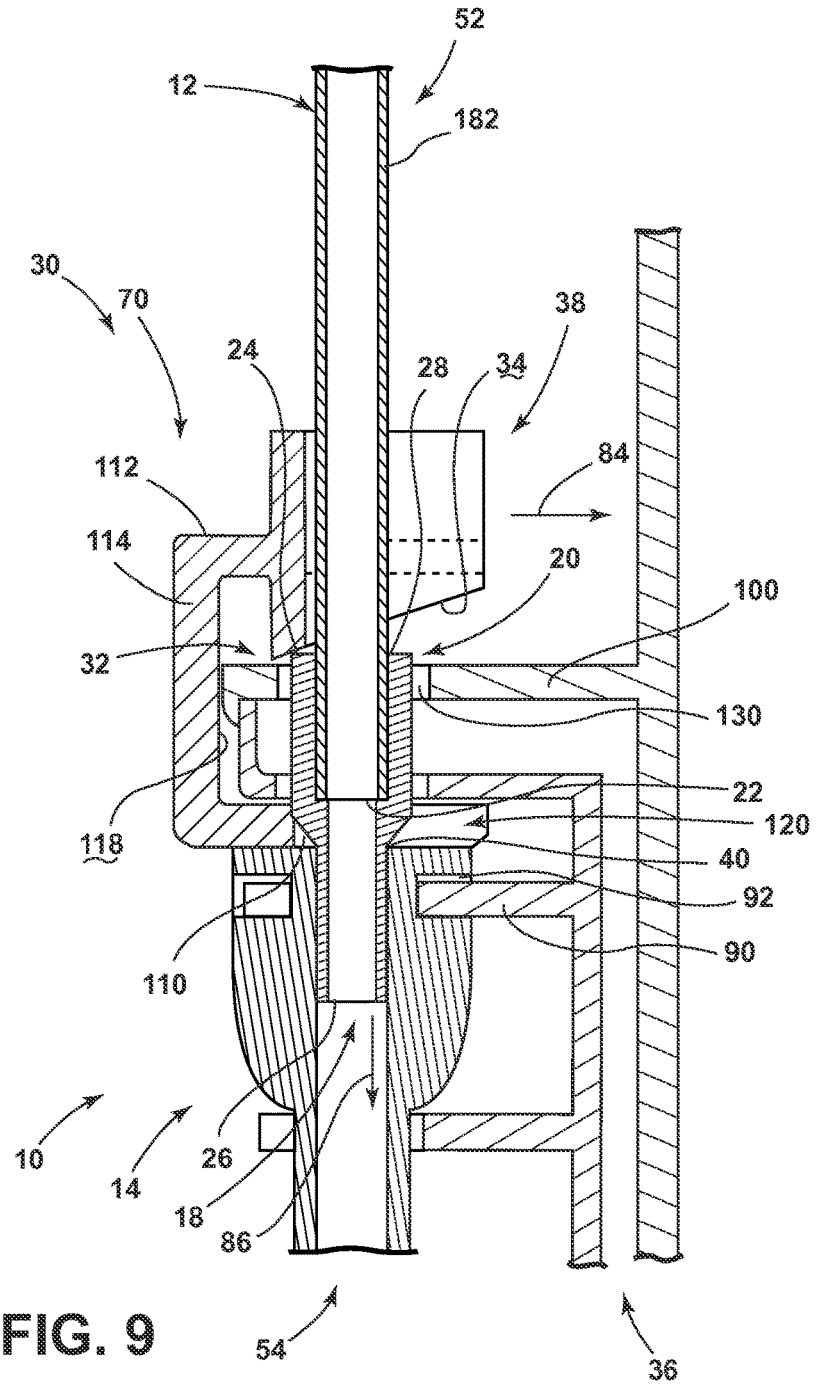
FIG. 9 is a cross-sectional view of the fluid valve assembly of FIG. 8 showing the fluid line guide in the guide position and the fluid line at the final insertion depth.

Referring again to the various embodiments exemplified in FIGS. 7-9, a portion of the valve housing 36 proximate the fluid valve 14 can include a collet alignment portion 130 through which the collet 20 is inserted to define at least the initial insertion depth 60 as well as the final insertion depth 18. In this manner, the collet alignment portion 130 of the valve housing 36 can serve to promote the linear movement of the collet 20 from the initial insertion position to the final insertion position as the fluid line guide 30 is moved into the guide position 38. Accordingly, the collet alignment portion 130 of the valve housing 36 can substantially prevent the non-linear movement of the collet 20 that might serve to dislodge the collet 20 from the fluid valve 14 and prevent installation of the collet 20 into the fluid valve 14.

Figure 3:
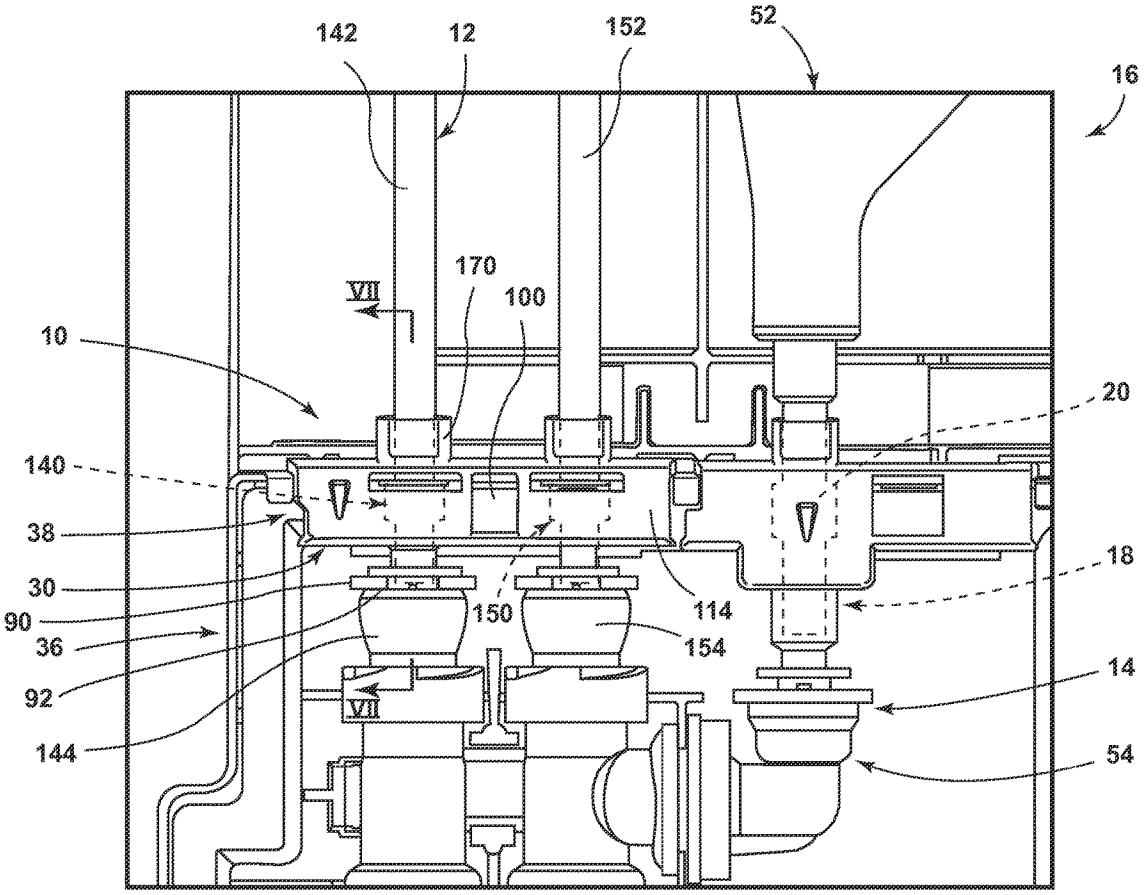
FIG. 3 is a front elevational view of the fluid valve assembly of FIG. 2.
Figure 4:
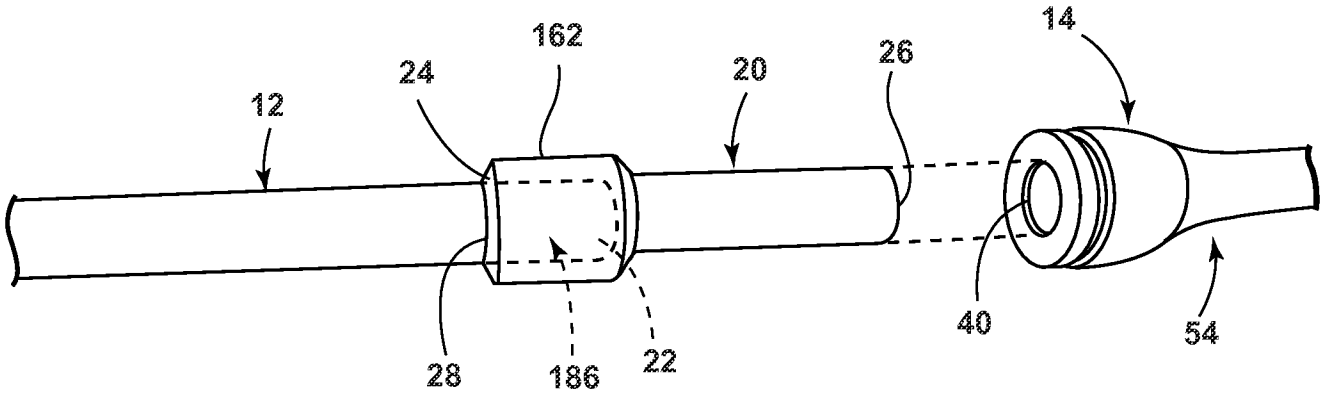
FIG. 4 is a side perspective view of a fluid line and collet for use in conjunction with the fluid line guide of FIG. 3.
Figure 6:
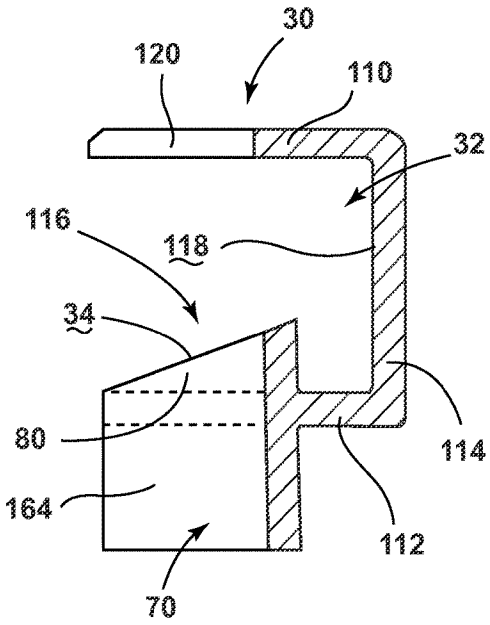
FIG. 6 is a cross-sectional view of the fluid line guide of FIG. 5 taken along line VI-VI.
Figure 5:
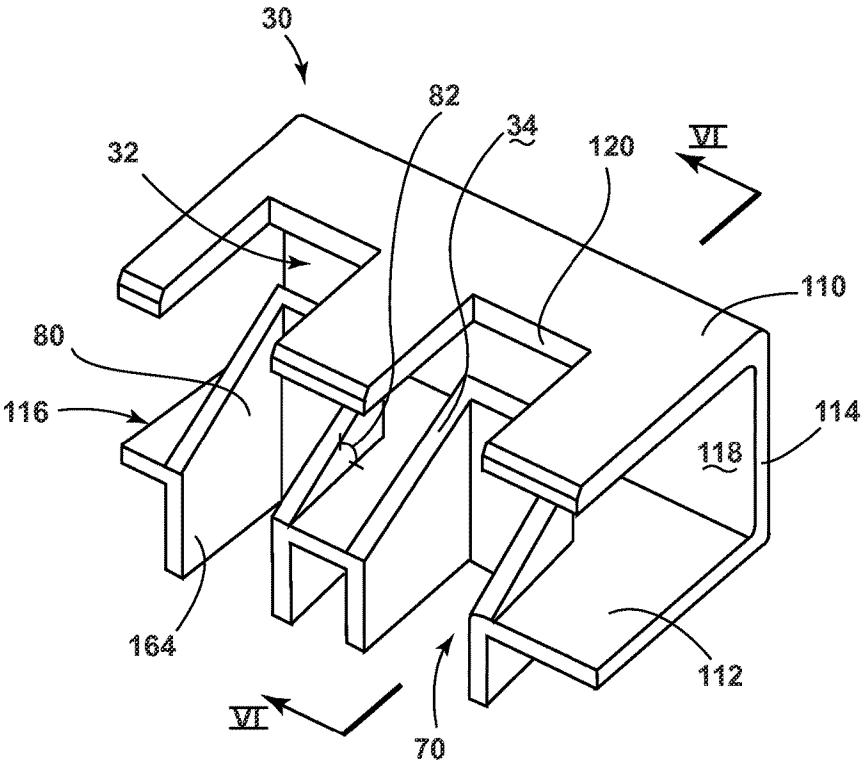
FIG. 5 is a top perspective view of another aspect of the fluid line guide.

Referring again to FIGS. 2-9, it is contemplated that the fluid line insertion guide 10 can be configured to install more than one fluid line 12 into several corresponding fluid valves 14. In this manner, a first collet 140 can be adapted for engagement on a first fluid line 142, where the first collet 140 includes a biased end 24 and an insertion end 26. The first fluid line 142 is configured to be inserted through the fluid line aperture 28 defined within the biased end 24 of the first collet 140 and the insertion end 26 is configured to be inserted into a first fluid valve 144 at the final insertion depth 18 to place the first fluid line 142 in communication with the first fluid valve 144 that is defined by the guide position 38 of the fluid line guide 30. As discussed above, the guide position 38 of the fluid line guide 30 is further defined by the first flange 110 engaging a portion of the valve housing 36 and the biased end 24 of the first collet 140 being positioned against the biasing surface 34 and within the retaining channel 32 of the fluid line guide 30, wherein the biasing surface 34 biases the insertion end 26 of the first collet 140 into the final insertion depth 18. While the fluid line insertion guide 10 exemplified in FIG. 3 shows two fluid lines 12 being connected, it is contemplated that the fluid line insertion guide 10, in various embodiments, can be used to connect a single fluid line 12, or more than two fluid lines 12 and can include a corresponding number of lateral support channels 70 and biasing surfaces 34.

According to various embodiments, the retaining channel 32 can also define the biasing region 116 within which the biasing surface 34 engages the biased end 24 of the collet 20. Where more than one fluid line 12 is used within the fluid line insertion guide 10, a second collet 150 can be adapted for engagement by a second fluid line 152, where the second collet 150 includes a biased end 24 and an insertion end 26. The second fluid line 152 is configured to be inserted through a fluid line aperture 28 defined within the biased end 24 of the second collet 150. The insertion end 26 is further configured to be inserted into a second fluid valve 154 to the final depth to place the second fluid line 152 in communication with the second fluid valve 154 and to further define the guide position 38. Again, the guide position 38 is further defined by the second collet 150 being positioned between the first flange 110 and the biasing surface 34 where a portion of the biasing surface 34 biases the insertion end 26 into the final insertion depth 18. According to the various embodiments, these components can be implemented for each fluid line 12 of the fluid valve assembly 54.

It is contemplated that in embodiments of the fluid line insertion guide 10 having multiple collets 20, fluid lines 12 and fluid valves 14, the fluid valve assembly 54 can also include multiple corresponding biased ends 24, insertion ends 26 and fluid line apertures 28 for each collet 20 included therein. Similarly, each fluid valve 14 can include a corresponding valve aperture 40, positioning slot 92, and other similar structures. Also, the fluid line guide 30 can include multiple lateral support channels 70 and guide apertures 120 for each fluid line 12 and collet 20 assembly.

In the various embodiments where two or more fluid lines 12 are installed through use of the fluid line insertion guide 10, the fluid line guide 30 can include one lateral support channel 70 and one guide aperture 120, for each fluid line 12 installed using the fluid line insertion guide 10. In other words, the fluid line guide 30 can include at least two lateral support channels 70 that are configured to receive, respectively, at least two corresponding fluid lines 12. Additionally, separate biasing surfaces 34 can be implemented for each combination of collet 20 and fluid line 12. In such an embodiment, the various biasing surfaces 34 can set each insertion end 26 of the various collets 20 at the same final insertion depth 18. It is also contemplated that the various biasing surfaces 34 can be configured to set each combination of collet 20 and fluid line 12 at separate and dedicated final insertion depths 18. In such an embodiment, each final insertion depth 18 can be different based upon the various configurations of the fluid valves 14 and the components of the fluid valve assembly 54 and the fluid delivery system 52 of the appliance 16.

Figure 10:
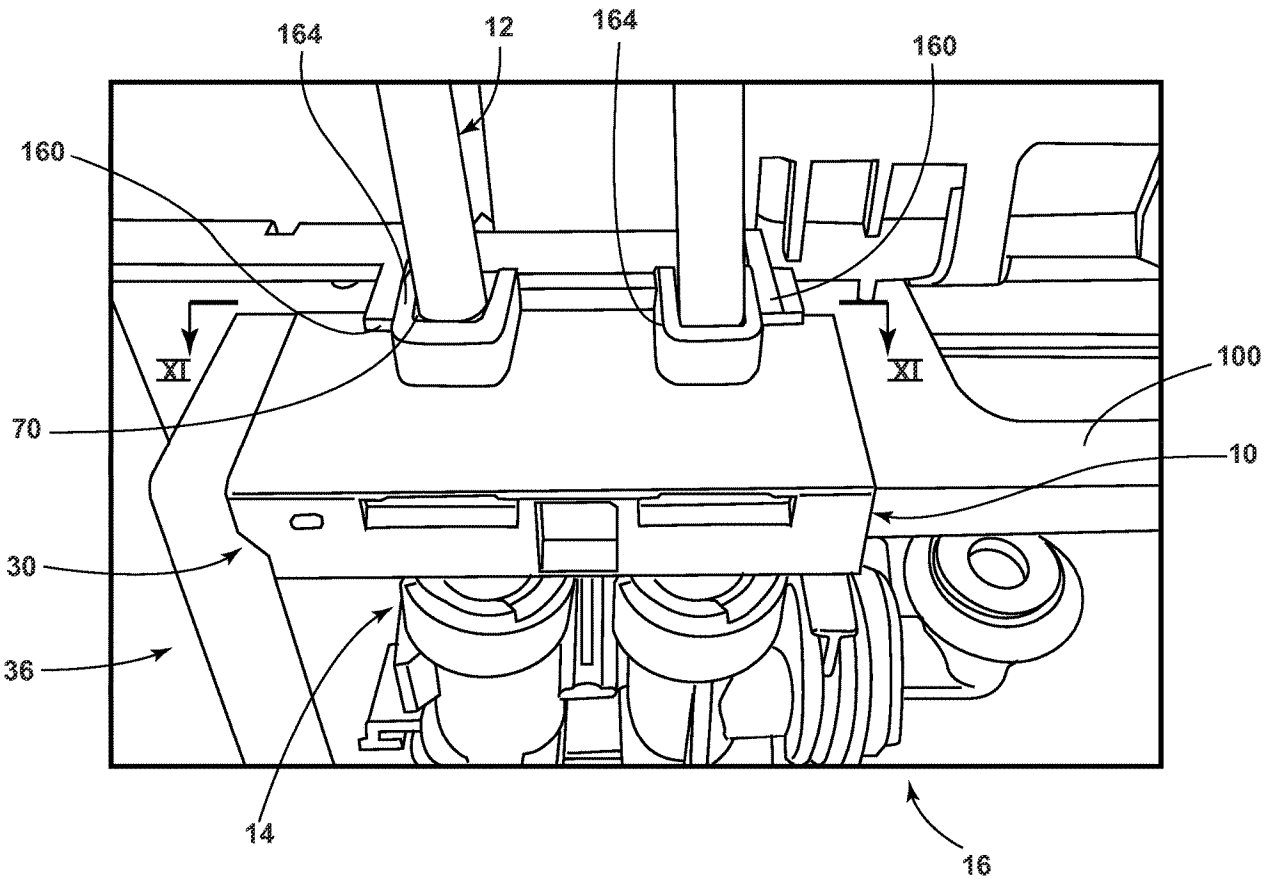
FIG. 10 is a top perspective view of an embodiment of the fluid valve assembly and incorporating an aspect of the guide ribs and showing the fluid line guide in the guide position.
Figure 11:
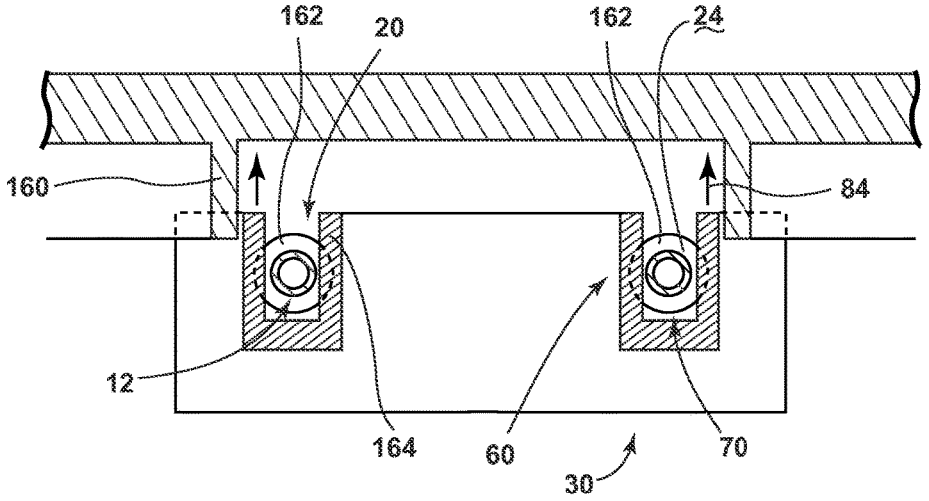
FIG. 11 is a cross-sectional view of the fluid valve assembly of FIG. 10 taken along line XI-XI and showing the fluid line guide being properly inserted onto the collet and the fluid valve assembly.
Figure 12:
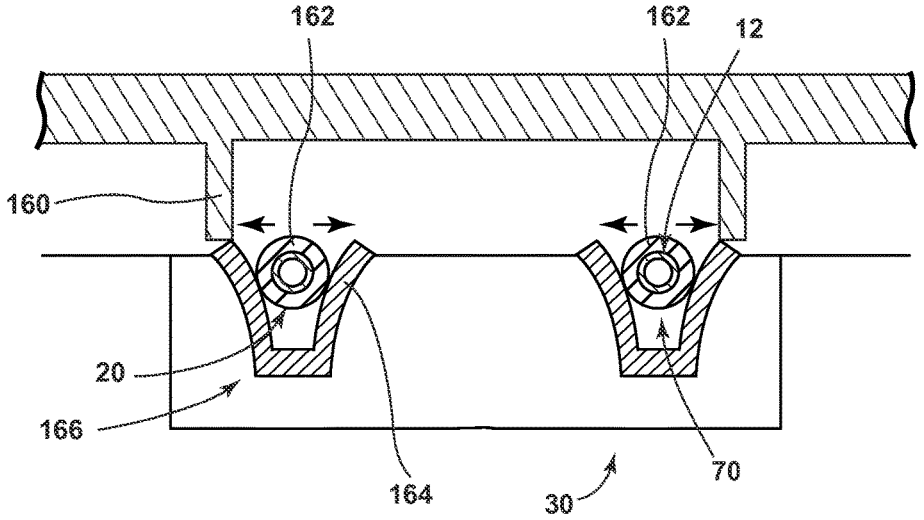
FIG. 12 is a cross-sectional view of the fluid valve assembly of FIG. 11 showing the fluid line guide being inserted onto the collet when the collet is in an improper installation position such that the tabs of the fluid valve assembly prevent the installation of the fluid line guide into the guide position.
Figure 13:
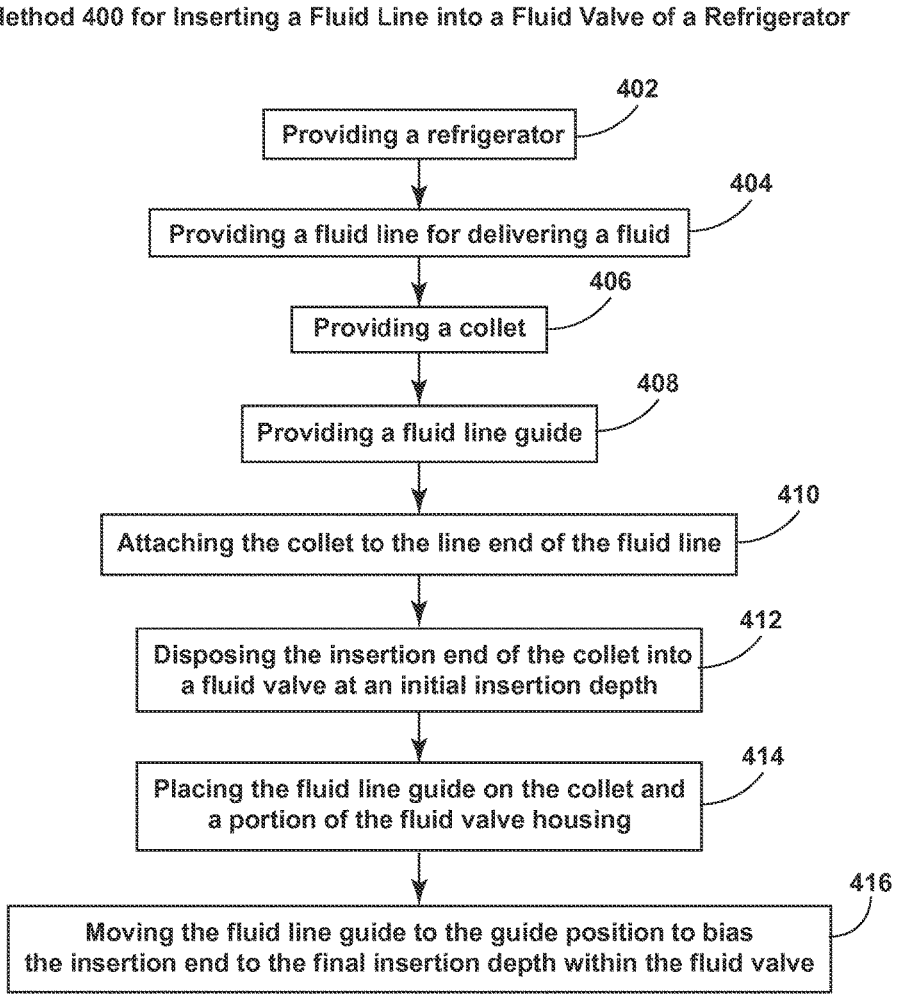
FIG. 13 is a schematic flow diagram illustrating a method for inserting a fluid line into a fluid valve assembly to insure a proper insertion depth.

Referring now to FIGS. 10-12, in order to achieve the proper initial insertion depth 60, the valve housing 36 can include at least one guide rib 160 that extends outward from a portion of the valve housing 36. During manufacture of the appliance 16, as the fluid lines 12 and respective collets 20 can be installed by hand and without the use of tools to define the initial insertion depth 60, it is necessary that a thickened portion 162 of the collet 20 achieve a minimal distance from the fluid valve 14 to insure that the collet 20 does not inadvertently fall out from the fluid valve 14. In order to insure this proper initial insertion depth 60, the one or more guide ribs 160 provide an interference mechanism to insure that the collet 20 is installed at this proper initial insertion depth 60. If the proper initial insertion depth 60 is achieved, when the fluid line guide 30 is inserted toward the guide position 38, at least one outer wall 164 of the lateral support channel 70 surrounds the fluid line 12 such that the biasing surface 34 of the lateral support channel 70 can engage the biased end 24 of the collet 20 and move the collet 20 in the generally perpendicular movement 86 toward the final insertion depth 18 (shown in FIGS. 10 and 11).

In situations where the collet 20 is not inserted into the proper initial insertion depth 60, it is possible that when the fluid line guide 30 is installed, the outer walls 164 of the lateral support channel 70 may deflect around the thickened portion 162 of the collet 20 such that the biasing surface 34 of the lateral support channel 70 does not engage the biased end 24 of the collet 20 (shown in FIG. 12). In such a situation, the collet 20 is not moved and the insertion end 26 of the collet 20 substantially remains at the initial insertion depth 60. Accordingly, the proper communication between the fluid line 12 and fluid valve 14 may not be achieved.

According to the various embodiments, as exemplified in FIGS. 10-12, the guide ribs 160 of the valve housing 36 are configured to prevent installation of the fluid line guide 30 into the guide position 38 when the collet 20 is not inserted at the initial insertion depth 60, which can be referred to as an improper installation position 166. When the collet 20 is in the improper installation position 166, and the outer walls 164 of the lateral support channel 70 deflect around the thickened portion 162 of the collet 20, at least one of the outer walls 164 of the lateral support channel 70 is configured to engage and be stopped by one or more of the guide ribs 160 to prevent further lateral movement 84 of the fluid line guide 30 to the guide position 38. Accordingly, the fluid line guide 30 cannot be moved to the guide position 38 until such time as the collet 20 is moved from the improper installation position 166 to at least the initial insertion depth 60. In this manner, the guide ribs 160 of the valve housing 36 insure that the collet 20 is positioned at least at the initial insertion depth 60 such that the biased end 24 of the collet 20 is properly positioned to receive the biasing surface 34 of the fluid line guide 30. Once this alignment is achieved, and the fluid line guide 30 is moved toward the guide position 38, the biasing surface 34 of the fluid line guide 30 biases the collet 20 toward the fluid valve 14 to achieve the final insertion depth 18. It is contemplated that the improper installation position 166 can be defined by the thickened portion 162 of the collet 20 outwardly biasing other portions of the fluid line guide 30 such that the fluid line guide 30 engages at least one of the guide ribs 160 to substantially prevents the fluid line guide 30 from moving into the guide position 38.

According to the various embodiments, it is contemplated that the valve housing 36 can include a plurality of guide ribs 160 positioned in such locations that when the collet 20 or a fluid line 12 is in an improper installation position 166, the fluid line guide 30 is prevented from being installed into the guide position 38. These guide ribs 160 can be configured to engage a deflected portion of the lateral support channel 70, a folded or kinked portion of the fluid line 12 as it enters the fluid valve 14, or other improperly positioned portion of the fluid line insertion guide 10.

Referring now to FIGS. 1-9 and 10-13, having described the apparatus of the fluid line insertion guide 10, a method 400 is disclosed for inserting a fluid line 12 into a fluid valve 14 of a refrigerator. The method 400 includes providing a refrigerator having a fluid valve 14 disposed proximate the valve housing 36 (step 402). According to various embodiments, the fluid valve 14 can be in communication with a portion of the fluid delivery system 52 of the refrigerator and/or a fluid-related function 50 of the appliance 16, such as a fluid dispenser 170, an ice maker 172, and others. Once the refrigerator is provided, a fluid line 12 of the appliance 16 is also provided (step 404) wherein the fluid line 12 is configured to deliver a fluid from the fluid valve 14 to a fluid-related function 50 of the appliance 16. A collet 20 is also provided (step 406), wherein the collet 20 includes a biased end 24 and an insertion end 26, wherein the biased end 24 includes a fluid line aperture 28 adapted to receive a fluid line 12. A fluid line guide 30 is provided (step 408), wherein the fluid line guide 30 includes a retaining channel 32 and a biasing surface 34, wherein the retaining channel 32 can be defined by first and second flanges 110, 112. The retaining channel 32 can also be defined between a first flange 110 and the biasing surface 34 where the second flange 112 and the biasing surface 34 form a single member that engages both the valve housing 36 and the biased end 24 of the collet 20.

According to the method 400, a collet 20 is attached to the fluid line 12 (step 410). In this manner, an end of the fluid line 12 is inserted through the fluid line aperture 28 of the biased end 24, and into an internal volume 186 of the collet 20 defined by the thickened portion 162 of the collet 20. The collet 20 can be attached by a mechanical or interference attachment or can be adhered to the fluid line 12 by adhesives or welding. It is also contemplated that the collet 20 can be over molded onto the fluid line 12 through injection molding, compression molding, or some other molding process. Once the collet 20 is attached to the fluid line 12, the insertion end 26 of the collet 20 is placed into the aperture of the fluid valve 14, wherein the insertion end 26 is positioned at the initial insertion depth 60 (step 412). As discussed above, the guide ribs 160 of the valve housing 36 can be used to insure that the fluid line 12 and the collet 20 are placed within the proper initial insertion depth 60.

According to various embodiments, it is contemplated that instead of a collet 20 being positioned over the line end 22 of the fluid line 12 to form the thickened portion 162, the thickened portion 162 can be a separate component over molded onto a portion of the fluid line 12 distal from the line end 22 of the fluid line 12. In such an embodiment, the insertion end 26 is defined by the line end 22 of the fluid line 12 and no collet 20 is positioned at or over the line end 22 of the fluid line 12. Accordingly, the structure that is over molded or otherwise attached to the fluid line 12 distal from the line end 22 defines the thickened portion 162, as well as the biased end 24 of the thickened portion 162. The portion of the fluid line 12 between the shoulder defining the thickened portion 162 and the line end 22 would be uncovered or substantiality uncovered such that the fluid line 12 in this region is fully exposed, or at least substantially exposed.

According to various embodiments, it is contemplated that the fluid line insertion guide 10 may not include a valve housing 36. In such embodiments, the first flange 110 and biasing surface 34 and/or the second flange 112 can engage a portion of the fluid valve 14. Accordingly, the positioning slot 92 of the fluid valve 14 can receive a portion of the fluid line guide 30 and promote the lateral movement 84 of the fluid line guide 30 into the guide position 38. It is also contemplated that the second flange 112 and/or the biasing surface 34 can slidably engage another portion of the fluid valve 14 or can only engage the biased end 24 of the collet 20.

It is also contemplated that the valve housing 36 can be limited to a wall member that is configured to receive the fluid line guide 30. Alternatively, the valve housing 36 can be a surrounding assembly that at least partially encases the various fluid valves 14 and, in certain embodiments, other components of the fluid delivery system 52 of the appliance 16.

Referring again to FIGS. 7-9 and 13, once the collet 20 is placed at the initial insertion depth 60, the fluid line guide 30 is placed on the collet 20 and at least a portion of the valve housing 36 (step 414). In this manner, the first flange 110 of the fluid line guide 30 slidably engages a portion of the valve housing 36. The second flange 112 can also slidably engage a portion of the valve housing 36 to define a guide position 38. In this guide position 38, the biasing surface 34 of the fluid line guide 30 is disposed a first distance from the valve aperture 40 of the fluid valve 14, such that the biasing surface 34 biases the biased end 24 of the collet 20 into the final insertion depth 18. Accordingly, when the fluid line guide 30 is placed in the guide position 38, the insertion end 26 of the collet 20 is placed at the final insertion depth 18 to insure proper communication between the fluid line 12 and the fluid valve 14. As discussed above, the method 400 includes moving the fluid line guide 30 toward the guide position 38. Again, the biasing surface 34 engages the biased end 24 of the collet 20 and biases the insertion end 26 of the collet 20 towards the final insertion depth 18 (step 416). The engagement of the first and second flanges 110, 112 with the valve housing 36 guides the movement of the fluid line guide 30 such that this movement is limited to a lateral movement 84 toward the guide position 38.

According to various embodiments, the biasing surface 34 of the fluid line guide 30 can be positioned outside of the retaining channel 32. In such an embodiment, the lateral support channel 70 can extend away from the retaining channel 32 such that the biasing surface 34 extends at the slope 82 away from the first flange 110. It is contemplated that the retaining channel 32 can be configured to engage the wall 100 of the valve housing 36. The collet 20 is then biased by the biasing surface 34 as the fluid line guide 30 is moved to the guide position 38. When in the guide position 38, the thickened portion 162 of the collet 20 is biased away from the retaining channel 32 by the biasing surface 34. In turn, the insertion end 26 of the collet 20 is biased into the final insertion depth 18. In such an embodiment, it is also contemplated that the guide aperture 120 may be defined within the second flange 112 to provide additional lateral support to the fluid line 12 to prevent unwanted deflection that may kink, fold, or otherwise deflect in a way that may impede the flow of fluid, cause leaks, or both, within the area of the engagement between the fluid line 12 and the fluid valve 14.

The invention claimed is:

1. A fluid line insertion guide for a refrigerator, the fluid line insertion guide comprising:

a collet adapted for engagement with an end of a fluid line, the collet including a biased end and an insertion end, wherein the fluid line is inserted through a fluid line aperture defined within the biased end;

a fluid valve that selectively receives the insertion end, wherein the insertion end is configured to be inserted into the fluid valve to a final insertion depth that places the fluid line in communication with the fluid valve;

a valve housing that selectively receives the insertion end of the collet; and a fluid line guide including a retaining channel and a biasing surface, wherein the retaining channel engages a portion of the valve housing to define a guide position, wherein when the fluid line guide is in the guide position, the insertion end is disposed within the valve housing and the biasing surface is disposed a predetermined distance from a valve aperture of the fluid valve, and wherein the guide position further defines a position of the biased end of the collet and the final insertion depth of the insertion end through the valve aperture and into the fluid valve, wherein the fluid line guide selectively operates into the guide position in a direction generally perpendicular to movement of the collet into the fluid valve.

2. The fluid line insertion guide of claim 1, wherein the biasing surface of the fluid line guide includes an angled biasing surface, wherein the angled biasing surface engages the biased end of the collet as the fluid line guide is moved into the guide position.

3. The fluid line insertion guide of claim 2, wherein linear movement of the fluid line guide into the guide position causes a perpendicular linear movement of the collet as the biasing surface biases the insertion end toward the final insertion depth, wherein the linear movement of the fluid line guide is substantially perpendicular to the fluid line.

4. The fluid line insertion guide of claim 3, wherein the linear movement of the fluid line guide into the guide position moves a support channel around the fluid line, wherein the support channel extends from the biasing surface.

5. The fluid line insertion guide of claim 4, wherein the fluid line guide includes at least two support channels for receiving at least two corresponding fluid lines, wherein the at least two corresponding fluid lines are configured to be in communication with a fluid dispenser and an ice maker, respectively.

6. The fluid line insertion guide of claim 1, wherein the retaining channel includes a support channel, wherein the support channel at least partially surrounds the fluid line and substantially positions the fluid line in a co-axial position with respect to the valve aperture.

7. The fluid line insertion guide of claim 6, wherein an upper portion of the support channel defines the biasing surface, wherein the biasing surface includes a predetermined slope, wherein the predetermined slope biases the collet into the valve aperture to define the final insertion depth of the insertion end.

8. The fluid line insertion guide of claim 6, wherein the support channel is positioned substantially perpendicular to the retaining channel.

9. The fluid line insertion guide of claim 1, wherein the valve housing includes at least one guide rib, wherein engagement of the fluid line guide with the at least one guide rib defines an improper installation position of the collet where the fluid line guide engages the at least one guide rib and prevents the fluid line guide from moving into the guide position.

10. The fluid line insertion guide of claim 9, wherein the improper installation position is defined by a thickened portion of the collet outwardly biasing a portion of the fluid line guide such that the fluid line guide engages the at least one guide rib and prevents the fluid line guide from moving into the guide position.

11. A fluid line insertion guide for a refrigerator, the fluid line insertion guide comprising:

a fluid line guide including a first flange and a biasing surface, wherein a biasing region is disposed between the first flange and the biasing surface, wherein the biasing surface selectively disposes a first fluid line at a final insertion depth with respect to a valve aperture; and a lateral support channel that extends downward from the biasing surface, wherein the lateral support channel in a guide position at least partially surrounds the first fluid line to position the first fluid line in a co-axial position with respect to the valve aperture, wherein operation of the fluid line guide to the guide position is generally perpendicular to a movement of the first fluid line into the co-axial position.

12. The fluid line insertion guide of claim 11, wherein the biasing surface slopes upward from a second flange toward the first flange.

13. The fluid line insertion guide of claim 12, further comprising:

a first collet disposed on the first fluid line, the first collet including a first biased end and a first insertion end, wherein the first fluid line is configured to be inserted through a first fluid line aperture defined within the first biased end, and wherein the first insertion end is configured to be inserted into a first fluid valve to the final insertion depth to place the first fluid line in communication with the first fluid valve to define a guide position, wherein the guide position is further defined by the first flange engaging a portion of a valve housing and the first biased end positioned against the biasing surface and within the biasing region, wherein the biasing surface biases the first insertion end to the final insertion depth.

14. The fluid line insertion guide of claim 13, wherein the valve housing includes at least one guide rib, wherein engagement of an outer wall of the lateral support channel with the at least one guide rib defines an improper installation position of the first collet, wherein the outer wall of the lateral support channel engages the guide rib and substantially prevents the fluid line guide from moving into the guide position.

15. The fluid line insertion guide of claim 14, further comprising:

a second collet adapted for engagement on a second fluid line, the second collet including a second biased end and a second insertion end, wherein the second fluid line is configured to be inserted through a second fluid line aperture defined within the second biased end, and wherein the second insertion end is configured to be inserted into a second fluid valve at the final insertion depth to place the second fluid line in communication with the second fluid valve to further define the guide position, wherein the guide position is further defined by the first flange engaging a portion of the second fluid valve and the second collet positioned between the first flange and the biasing surface with a portion of the biasing surface biasing the second insertion end into the final insertion depth.

16. The fluid line insertion guide of claim 15, wherein a second lateral support channel extends downward from the biasing surface, wherein the second lateral support channel at least partially surrounds the second fluid line and positions the second fluid line in a substantially co-axial position with respect to a second valve aperture.

17. The fluid line insertion guide of claim 15, wherein the first and second fluid lines, when in the guide position, are configured to be in communication with a fluid dispenser and an ice maker, respectively.

* * * * *